US010916172B2

(12) United States Patent
Jiang et al.

(10) Patent No.: US 10,916,172 B2
(45) Date of Patent: Feb. 9, 2021

(54) STAGE-NUMBER REDUCED GATE ON ARRAY CIRCUIT AND DISPLAY DEVICE

(71) Applicant: TCL CHINA STAR OPTOELECTRONICS TECHNOLOGY CO., LTD., Guangdong (CN)

(72) Inventors: Zhixiong Jiang, Guangdong (CN); Yanhong Meng, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/616,971

(22) PCT Filed: Nov. 12, 2019

(86) PCT No.: PCT/CN2019/117485

§ 371 (c)(1),
(2) Date: Nov. 26, 2019

(65) Prior Publication Data

US 2021/0012694 A1 Jan. 14, 2021

(30) Foreign Application Priority Data

Jul. 11, 2019 (CN) ..... 2019 1 0623575

(51) Int. Cl.
*G09G 3/20* (2006.01)

(52) U.S. Cl.
CPC ..... *G09G 3/20* (2013.01); *G09G 2310/0297* (2013.01)

(58) Field of Classification Search
CPC ..... G09G 3/20; G09G 2310/0297
See application file for complete search history.

(56) References Cited

U.S. PATENT DOCUMENTS

2006/0007195 A1* 1/2006 Hu ..... G09G 3/3648 345/204
2006/0267909 A1 11/2006 Hsu et al.
2009/0079669 A1 3/2009 Huang et al.
(Continued)

FOREIGN PATENT DOCUMENTS

CN 1635567 A 7/2005
CN 102543028 A 7/2012
(Continued)

*Primary Examiner* — Brent D Castiaux
(74) *Attorney, Agent, or Firm* — Mark M. Friedman

(57) ABSTRACT

The present disclosure provides a stage-number reduced gate driver on array (GOA) circuit and a display device. The circuit includes one or more stages of GOA sub-circuits. Each stage of GOA sub-circuits includes a gate signal input end, an original output end, one or more sub-output ends, and one or more branching devices respectively corresponding to the one or more sub-output ends. The gate signal input end and the original output end are respectively connected to a branching node. One end of the one or more branching devices is respectively connected to the branching node. Another end of the one or more branching devices is connected to the corresponding one or more sub-output ends. The present disclosure can solve the problem of excessive length of the GOA circuit in high-resolution model which is not conducive to a narrow bezel design.

14 Claims, 3 Drawing Sheets

(56) References Cited

U.S. PATENT DOCUMENTS

| | | | | |
|---|---|---|---|---|
| 2014/0204011 | A1 | 7/2014 | Hu et al. | |
| 2015/0161956 | A1 | 6/2015 | Lee et al. | |
| 2015/0295575 | A1* | 10/2015 | Lee | H03K 17/693<br>327/416 |
| 2017/0186392 | A1 | 6/2017 | Kuo et al. | |
| 2019/0156722 | A1* | 5/2019 | Li | G09G 3/3674 |

FOREIGN PATENT DOCUMENTS

| | | | |
|---|---|---|---|
| CN | 103106881 | A | 5/2013 |
| CN | 103943090 | A | 7/2014 |
| CN | 104036747 | A | 9/2014 |
| CN | 104700796 | A | 6/2015 |
| CN | 105096874 | A | 11/2015 |
| CN | 107610634 | A | 1/2018 |

* cited by examiner

STAGE-NUMBER REDUCED GATE ON ARRAY CIRCUIT AND DISPLAY DEVICE

FIELD OF INVENTION

The present disclosure relates to the field of display technology, and more particularly, to a stage-number reduced gate on array circuit and a display device.

BACKGROUND OF INVENTION

As requirements for resolutions of display screens become higher and higher, the resolutions of displays change from FHD (full high definition) and UD (ultra-high definition) to 8K or even 16K. A number of gate stages also increases exponentially. For gate driver on array (GOA) technology, a width reserved for GOA wires becomes increasingly narrower. In order to dispose all functional modules of the GOA, a length of wiring areas of the GOA wires can only be lengthened. As shown in FIG. 1 and FIG. 2, in the present technologies, when using panels which have a same size to achieve 4K resolution or 8K resolution, it can be seen from a comparison between occupied areas of the panels that the shape of area is limited and spatial distribution is unreasonable. Present GOA circuits are not conducive to achieving a narrow bezel. Please refer to FIG. 3, in the present technologies, each stage of the gate signal requires an individual stage of GOA circuit for output. Thus, an entire occupation of circuit becomes too long.

Technical Problems

In the present technologies, when panels which have the same size but display in 4K resolution and 8K resolution respectively, from the comparison between occupied areas of the panels, the shape of area is limited and spatial distribution is unreasonable. Present GOA circuits are not conducive to achieving a narrow bezel. Please refer to FIG. 3, in the present technologies, each stages of the gate signal requires an individual stage of GOA circuit for output. Thus, the entire occupation of circuit becomes too long.

Therefore, disadvantages of the present GOA circuits require a stage-number reduced gate on array circuit to improve these disadvantages.

SUMMARY OF INVENTION

The present disclosure provides a stage-number reduced gate on array circuit and a display device for implementing narrow bezel design and solving the problems existing in the present published technologies.

The present disclosure provides a stage-number reduced gate driver on array (GOA) circuit and a display device for implement narrower bezel to solve existing technical problems.

The present disclosure provides the stage-number reduced GOA circuit comprises one or more stages of GOA sub-circuits. Each of the GOA sub-circuits comprises a gate signal input end, an original output end, one or more sub-output ends, and one or more branching devices corresponding to the sub-output end.

The gate signal input end and the original output end are connected to a branching node. A first end of the one or more branching devices is connected to the branching node. A second end of the one or more branching devices is connected to one or more corresponding sub-output ends.

In the stage-number reduced GOA circuit of the present disclosure, the branching devices are thin film transistors (TFTs).

In the stage-number reduced GOA circuit of the present disclosure, the branching node is a gate demultiplexer for branching a gate signal of the gate signal input end to a plurality of output gate signals.

In the stage-number reduced GOA circuit of the present disclosure, a number of the sub-output end of each stage of the sub-GOA unit is n, a number of the branching devices is n, the one or more sub-output ends comprise a first sub-output end, a second sub-output end, . . . a (i)th sub-output end, . . . , and a (n)th sub-output end, and the one or more branching devices comprises a first branching device, a second branching device, . . . a (i)th branching device, . . . , and a (n)th branching device.

In the stage-number reduced GOA circuit of the present disclosure, a turn-on time of the (i)th branching device is at a i/(n+1) turn-on time of the gate signal of the gate signal input end, a turn-off time of the (i)th branching device is at a (i+1)/(n+1) turn-on time of the gate signal of the gate signal input end, so that a gate signal of the (i)th sub-output end delays for a duration of the gate signal of the gate signal input end multiplying i/(n+1) than the gate signal of the gate signal input end.

In the stage-number reduced GOA circuit of the present disclosure, a gate signal of the (i)th branching device delays for a duration of the gate signal of the gate signal input end multiplying 1/(n+1) than a gate signal of the (i+1)th branching device.

In the stage-number reduced GOA circuit of the present disclosure, a stage-number of the sub-GOA unit is m, and the one or more stages of the sub-GOA comprises a first GOA sub-circuit, a second GOA sub-circuit, . . . a (j)th GOA sub-circuit, . . . , and a (m)th GOA sub-circuit.

In the stage-number reduced GOA circuit of the present disclosure, a gate signal of the gate signal input end of the (j+1)th sub-GOA unit delays for a duration of the gate signal of the gate signal input end than a gate signal of the (j)th sub-GOA unit.

In the stage-number reduced GOA circuit of the present disclosure, a signal of the gate signal input end is the same as a signal of the original output end.

The present disclosure further provides a display device includes the stage-number reduced GOA circuit described above.

the present disclosure provides a display device includes the display panel described above.

Beneficial Effect

The present disclosure provides solutions for over-length GOA circuits of high-resolution models and solutions for designing narrow bezels. The present disclosure reduces the area of the GOA circuit to 1/N in comparison with the original GOA circuit and more reasonably utilizes the area of the GOA circuit so that stage number of GOAs is reduced and narrow bezel design can be achieved.

DESCRIPTION OF DRAWINGS

In order to clarify embodiments or technical solutions of the present technologies, the required drawings of the embodiments or the technical solutions will be briefly described below. Obviously, the drawings in the following description are merely parts of embodiments. Additional drawings may be obtained by a skilled person in the art without creative effort according to the following drawings

REFERENCE NUMBERS

Figure 1:
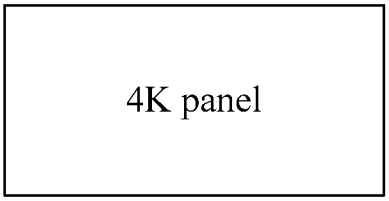
FIG. 1 illustrates a schematic area occupied by a single stage of gate driver on array (GOA) unit of a 4K panel of the present technology.
Figure 2:
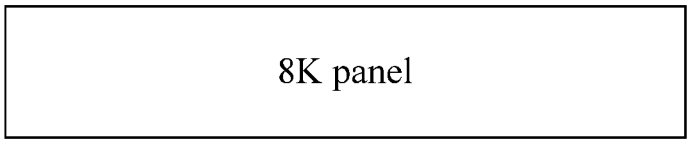
FIG. 2 illustrates a schematic area occupied by a single stage of GOA unit of an 8K panel of the present technology.
Figure 3:
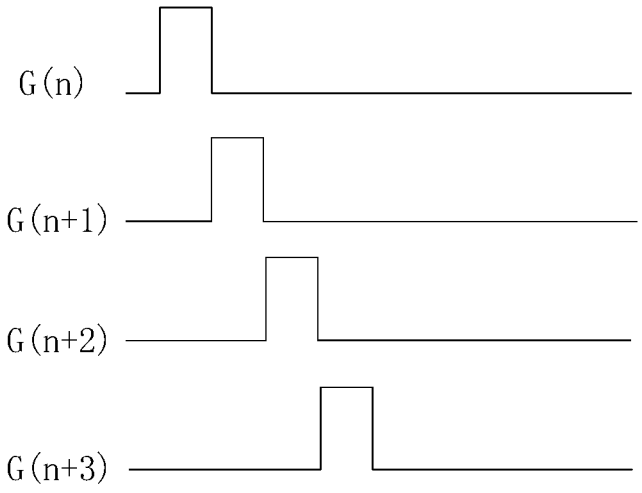
FIG. 3 illustrates schematic waveforms of gate signals of the present technology.

1 gate signal input end
2 original output end
3 sub-output end
4 branching device
5 branching node
10 GOA sub-circuit

DETAILED DESCRIPTION OF PREFERRED EMBODIMENTS

For clarifying technical features, objectives, and effects of the present disclosure, the embodiments of the present disclosure are described in detail with reference to the accompanying drawings.

Figure 4:
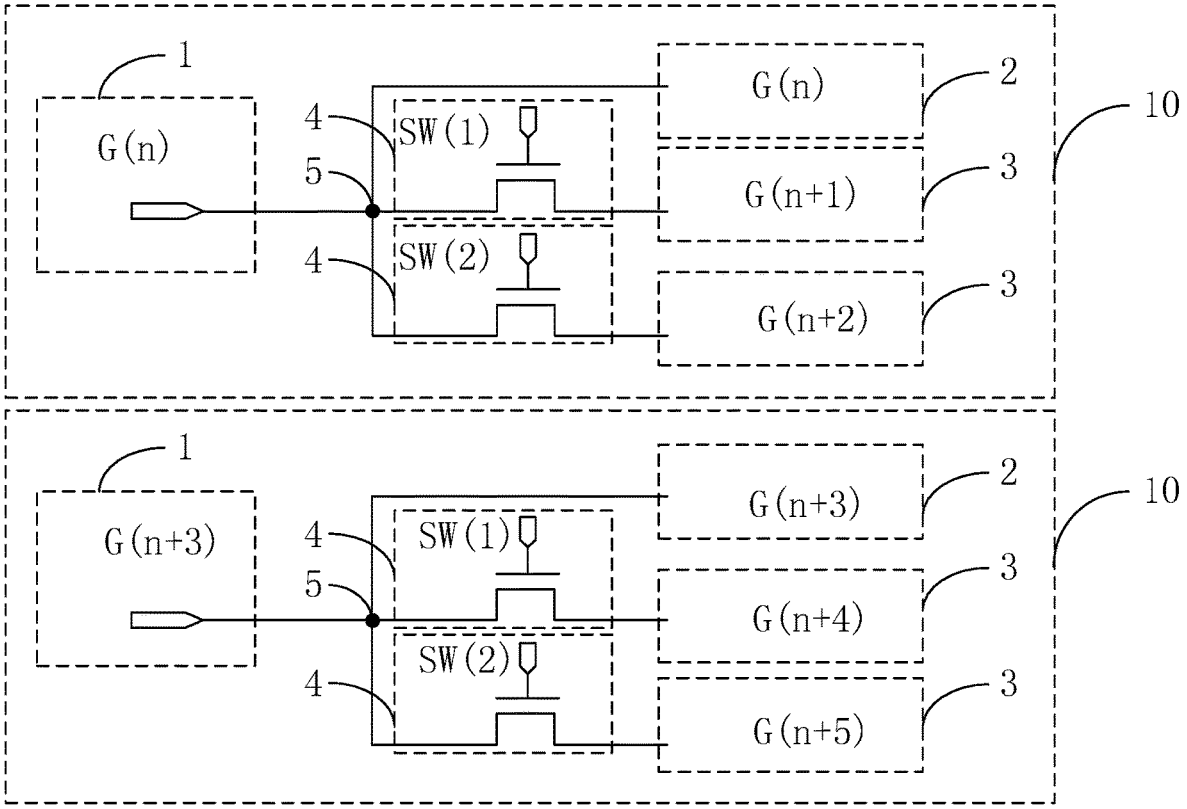
FIG. 4 illustrates a circuit of a stage-number reduced GOA of an embodiment of the present disclosure.

Please refer to FIG. 4, which is a diagram of a stage-number reduced gate driver on array (GOA) circuit provided by an embodiment of the present disclosure. The stage-number reduced GOA circuit includes one or more stages of GOA sub-circuits 10. Each stage of the GOA sub-circuits 10 includes a gate signal input end 1, an original output end 2, one or more sub-output ends 3, and one or more branching devices 4 respectively corresponding to the one or more of sub-output ends 3. The branching device 4 is preferably a switching thin film transistor (i.e. switch TFT).

In the embodiment shown in FIG. 4, the stage-number reduced GOA circuit includes two stages of GOA sub-circuit 10.

In a first stage of the GOA sub-circuit 10, the gate signal input end 1 is G(n) on the left side, and the original output end 2 is G(n) on the right side. A first sub-output end 3 is G(n+1). A second sub-output end 3 is G(n+2). A first branching device 4 is SW(1). A second branching device 4 is SW(2). The G(n) on the left side and the G(n) on the right side are connected through a branching node 5. One end of the SW(1) and one end of the SW(2) are also respectively connected to the branching node 5. In order to implement branching, the branching node 5 is implemented by a gate demux, so that a gate signal of the gate signal input end 1 is divided into multiple output gate signals. That is, G(n) is separated into G(n), G(n+1), and G(n+2) by two switch TFTs while the G(n) output is maintained. The other end of SW(1) is connected to G(n+1). The other end of SW(2) is connected to G(n+2).

Similarly, in a second stage of the GOA sub-circuit 10, the gate signal input end 1 is G(n+3) on the left side, and the original output end 2 is G(n+3) on the right side. The first sub-output end 3 is G(n+4). The second sub-output end 3 is G(n+5). The first branching device 4 is SW(1). The second branching device 4 is SW(2).

In this embodiment, a stage number of GOA circuit can be reduced to ⅓ in comparison with the original GOA circuit by disposing two switch TFTs.

Figure 5:
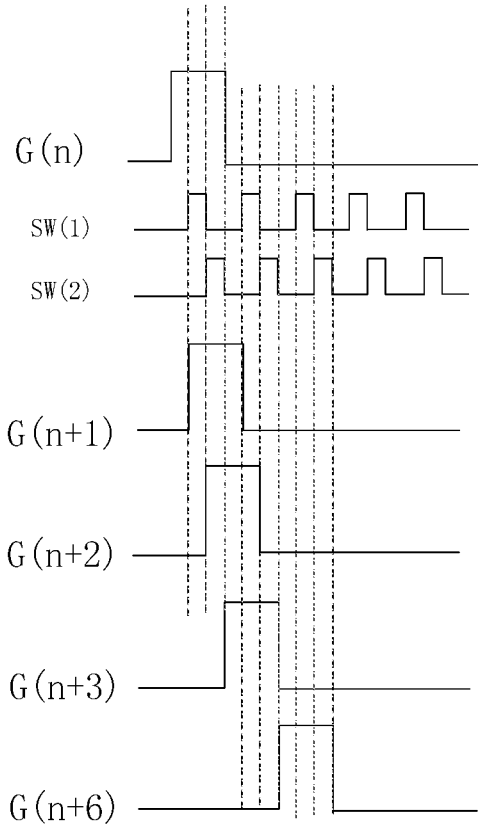
FIG. 5 illustrates schematic waveforms of an original output signal, gate signals of thin-film transistors, and sub-output signals of an embodiment of the present disclosure.

Refer to FIG. 5, which is an illustration of schematic waveforms of the original output terminal 2, the switching thin film transistor, and the sub-output end 3 provided by the embodiment of the present disclosure. The gate signal input end 1 G(n) has a same high potential (28 V) and a same low potential (−6 V) as the two branching devices 4 SW(n). A turn-on time of the switching thin film transistor SW(1) is ⅓ of the turn-on duration of G(n). A turn-off time of the switching thin film transistor SW(1) is at ⅔ of the turn-on duration of G(n). A turn-on time of the switching thin film transistor SW(2) is at ⅔ of the turn-on duration of G(n). A turn-off time of the switching thin film transistor SW(2) is same as the time the gate is turned off.

It can be found that a first output signal divided from G(n), outputted from the gate signal input end 1, is G(n+1) outputted from the first sub-output end 3. The rising edge of the G(n+1) is at the ⅓ of the turn-on duration of G(n). In other words, the switching thin film transistor SW(1) is turned on at ⅓ duration of G(n) and is turned off at ⅔ duration of G(n) to form the gate signal G(n+1). Similarly, the second sub-output end 3 outputs G(n+2). G(n+2) is turned on at ⅔ of the duration of G(n). The switching thin film transistor SW(2) outputs the gate signal G(n+2).

The embodiment shown in FIG. 4 is implemented by adding two switch TFTs. As a result, in the second-stage sub-circuit 10, the turn-on time of G(n+3) after the rising edge of G(n) is a delayed duration of the high voltage potential of G(n). The duration of the high voltage potential of G(n) and the duration of the high voltage potential of G(n+3) are the same. G(n+4) and G(n+5) are generated similarly. The figure also shows the waveform diagram of G(n+6). The turn-on time of G(n+6) is just after the turn-on time of G(n+3) by delaying a duration of the high voltage potential of G(n). The duration of the high voltage potential of G(n+3) and the duration of the high voltage potential of G(n+6) are the same.

In practice, the GOA sub-circuit 10 can be expanded according to the situation. If desiring to reduce the number of stages of the GOA circuit by half, only one switch TFT is needed. If desiring to reduce the number of stages of the GOA circuit by ¼, three switch TFTs are needed, and so on.

The GOA demultiplexer (demux) circuit provided by the present disclosure can solve the problems of unreasonable space utilization and difficulty of narrower bezel, which result from an excessive number of circuit stages. After passing through the branching devices, the outputted gate waveform is consistent with the inputted gate waveform. As a result, when the present disclosure has same performance, the stage number of GOA circuits is reduced to 1/N in comparison with the original GOA circuit and the area of the GOA circuit is more reasonably utilized.

Furthermore, the present disclosure also provides a display device comprising the stage-number reduced GOA circuit as described above.

The embodiments of the present disclosure have been described above with reference to the accompanying drawings, but the present disclosure is not limited to the specific embodiments described above. The above detailed description is merely illustrative instead of restrictive. A skilled person in the art may obtain more embodiments without departing from the scope of the present disclosure and the scope of the claims. Those embodiments are also fall within the protected scope of the present disclosure.

What is claimed is:

1. A stage-number reduced gate driver on array (GOA) circuit, comprising one or more stages of GOA sub-circuits, wherein each of the GOA sub-circuits comprises a gate signal input end, an original output end, one or more sub-output ends, and one or more branching devices corresponding to the one or more sub-output ends; and the gate signal input end and the original output end are connected to a branching node, a first end of the one or more branching devices is connected to the branching node, and a second end of the one or more branching devices is connected to one or more corresponding sub-output ends;

wherein a number of the one or more sub-output ends of each stage of the sub-GOA unit is n, a number of the one or more branching devices is n, the one or more sub-output ends comprise a first sub-output end, a second sub-output end, . . . a (i)th sub-output end, . . . , and a (n)th sub-output end, and the one or more branching devices comprises a first branching device, a second branching device, . . . a (i)th branching device, . . . , and a (n)th branching device;

wherein a turn-on time of the (i)th branching device is at a i/(n+1) turn-on time of the gate signal of the gate signal input end, and a turn-off time of the (i)th branching device is at a (i+1)/(n+1) turn-on time of the gate signal of the gate signal input end, so that a gate signal of the (i)th sub-output end delays for a duration of the gate signal of the gate signal input end multiplying i/(n+1) compared to the gate signal of the gate signal input end.

2. The stage-number reduced GOA circuit according to claim 1, wherein the one or more branching devices are switching thin film transistors (TFTs).

3. The stage-number reduced GOA circuit according to claim 1, wherein the branching node is a gate demultiplexer for branching a gate signal of the gate signal input end into a plurality of output gate signals.

4. The stage-number reduced GOA circuit according to claim 1, wherein a gate signal of the (i)th branching device delays for a duration of the gate signal of the gate signal input end multiplying 1/(n+1) compared to a gate signal of the (i+1)th branching device.

5. The stage-number reduced GOA circuit according to claim 1, wherein a stage-number of the sub-GOA unit is m, and the one or more stages of the sub-GOA comprise a first GOA sub-circuit, a second GOA sub-circuit, . . . a (j)th GOA sub-circuit, . . . , and a (m)th GOA sub-circuit.

6. The stage-number reduced GOA circuit according to claim 5, wherein a gate signal of a gate signal input end of the (j+1)th sub-GOA unit delays for a duration of the gate signal of the gate signal input end compared to a gate signal of the (j)th sub-GOA unit.

7. The stage-number reduced GOA circuit according to claim 1, wherein a signal of the gate signal input end is same as a signal of the original output end.

8. A display device, wherein the display device comprises a stage-number reduced gate driver on array (GOA) circuit comprising one or more stages of GOA sub-circuits, wherein each of the GOA sub-circuits comprises a gate signal input end, an original output end, one or more sub-output ends, and one or more branching devices corresponding to the one or more sub-output ends; and the gate signal input end and the original output end are connected to a branching node, a first end of the one or more branching devices is connected to the branching node, and a second end of the one or more branching devices is connected to one or more corresponding sub-output ends;

wherein a number of the one or more sub-output ends of each stage of the sub-GOA unit is n, a number of the branching devices is n, the one or more sub-output ends comprise a first sub-output end, a second sub-output end, . . . a (i)th sub-output end, . . . , and a (n)th sub-output end, and the one or more branching devices comprises a first branching device, a second branching device, . . . a (i)th branching device, . . . , and a (n)th branching device;

wherein a turn-on time of the (i)th branching device is at a i/(n+1) turn-on time of the gate signal of the gate signal input end, and a turn-off time of the (i)th branching device is at a (i+1)/(n+1) turn-on time of the gate signal of the gate signal input end, so that a gate signal of the (i)th sub-output end delays for a duration of the gate signal of the gate signal input end multiplying i/(n+1) compared to the gate signal of the gate signal input end.

9. The display device according to claim 8, wherein the one or more branching devices are switching thin film transistors (TFTs).

10. The display device according to claim 8, wherein the branching node is a gate demultiplexer for branching a gate signal of the gate signal input end into a plurality of output gate signals.

11. The display device according to claim 8, wherein a gate signal of the (i)th branching device delays for a duration of the gate signal of the gate signal input end multiplying 1/(n+1) compared to a gate signal of the (i+1)th branching device.

12. The display device according to claim 8, wherein a stage-number of the sub-GOA unit is m, and the one or more stages of the sub-GOA comprise a first GOA sub-circuit, a second GOA sub-circuit, . . . a (j)th GOA sub-circuit, . . . , and a (m)th GOA sub-circuit.

13. The display device according to claim 12, wherein a gate signal of a gate signal input end of the (j+1)th sub-GOA unit delays for a duration of the gate signal of the gate signal input end than a gate signal of the (j)th sub-GOA unit.

14. The display device according to claim 8, wherein a signal of the gate signal input end is same as a signal of the original output end.

* * * * *